US006421833B2

(12) United States Patent
Khanamirian et al.

(10) Patent No.: US 6,421,833 B2
(45) Date of Patent: Jul. 23, 2002

(54) APPAREL HAVING SIDE-ADJUSTABLE SHOULDER SUPPORTS

(75) Inventors: Alexander Khanamirian, Miami Beach, FL (US); Thomas R. Swetish, Racine, WI (US)

(73) Assignee: Extrasport, Inc., Miami, FL (US)

( * ) Notice: Subject to any disclaimer, the term of this patent is extended or adjusted under 35 U.S.C. 154(b) by 0 days.

(21) Appl. No.: 09/865,087

(22) Filed: May 24, 2001

Related U.S. Application Data

(60) Provisional application No. 60/206,856, filed on May 24, 2000.

(51) Int. Cl.[7] ..... B63C 11/02

(52) U.S. Cl. ..... 2/69; 182/3; 405/186

(58) Field of Search ..... 2/69, 456, 460–463, 2/467, 44, 45, 50, 51, 69.5, 2.5, 94, 102, 108, 326, 327, 328–334; 182/3–6; 224/260, 262, 615–616, 907; 244/151 R, 151 A, 143; 119/907; 405/186; 441/84, 87–88, 106, 108, 111–118

(56) References Cited

U.S. PATENT DOCUMENTS 1,114,739 A 10/1914 Dobinch
1,511,006 A 10/1924 Prescott
3,783,449 A * 1/1974 Davis ..... 2/2.5
4,177,877 A * 12/1979 Gallinati ..... 182/3
D280,844 S 10/1985 Evert
4,545,773 A 10/1985 Evert
4,660,751 A 4/1987 von Dewitz
4,860,936 A 8/1989 Lowe
5,323,942 A * 6/1994 Dahan ..... 224/639
5,586,705 A 12/1996 Leonard
5,662,433 A 9/1997 Seligman
5,690,413 A 11/1997 Coughlin
5,746,632 A 5/1998 Theberge
6,120,213 A * 9/2000 Stinton ..... 405/186

* cited by examiner

*Primary Examiner*—Gloria M. Hale
*Assistant Examiner*—Tejash Patel
(74) *Attorney, Agent, or Firm*—Foley & Lardner

(57) ABSTRACT

The apparel includes a front portion, a rear portion, a first continuous member and a second continuous member. The front portion is configured to extend along a wearer's chest while the rear portion is configured to extend along the wearer's back. The first continuous member and the second continuous member extend between the front portion and the rear portion across the wearer's shoulders when the apparel is worn. The first continuous member and the second continuous member further slidably extend along one or both of the front portion and the rear portion. The first continuous member and the second continuous member each also extend between the front portion and the rear portion along the wearer's side when the apparel is worn. The first continuous member and the second continuous member each have an adjustable length.

26 Claims, 3 Drawing Sheets

APPAREL HAVING SIDE-ADJUSTABLE SHOULDER SUPPORTS

This application claims priority under 35 U.S.C. §119 from U.S. Provisional Application Ser. No. 60/206,856, filed on May 24, 2000 and entitled PERSONAL FLOTATION DEVICE HAVING SIDE-ADJUSTABLE SHOULDER SUPPORTS, the full disclosure of which is hereby incorporated by reference.

FIELD OF THE INVENTION

The present invention relates to apparel including shoulder straps or shoulder supports. In particular, the present invention relates to such apparel wherein the shoulder supports are adjustable at locations proximate the sides of a person wearing the apparel.

BACKGROUND OF THE INVENTION

Various apparel such as backpacks, buoyancy compensators and life jackets or personal flotation devices (PFD's) include vest-like configured bodies having shoulder supports. Such shoulder supports are formed as straps or webbing and extend from the wearer's chest, across the wearer's shoulders, and to the wearer's back. Due to different anatomies of different wearers, it is frequently desirable to adjust the length of the shoulder supports extending across the wearer's shoulders to thereby adjust the relative positioning of front or rear portions of the apparel on the wearer.

Such shoulder supports typically have a first end affixed to a rear portion of the apparel and a second end adjustably affixed to the front portion of the apparel. Adjustment is typically achieved by pulling the shoulder strap through a buckle or ladder lock. The buckle or ladder lock is typically located proximate the wearer's shoulders and at or above the chest of the person wearing the piece of apparel.

Although the buckles allow the person wearing the apparel to adjust the length of the shoulder supports, the buckles are frequently difficult to access and adjust. In particular, because the buckles are located at or above the individual's chest, accessing and grasping the buckle is difficult and tedious, making adjustment difficult. Adjustment of the shoulder supports is even more difficult in those pieces of apparel, such as personal flotation devices, that inherently restrict complete freedom of movement due to one or more layers of relatively thick flotation foam or material. At the same time, with personal flotation devices, appropriate adjustment of the personal flotation device is even more critical to ensure safety to the person wearing the personal flotation device.

Thus, there is a continuing need for a piece of apparel having easily adjustable shoulder supports. There is also a continuing need for easily adjustable shoulder supports in those pieces of apparel which inherently restrict complete freedom of movement. Furthermore, there is a continuing need for personal flotation devices having easily adjustable shoulder supports.

SUMMARY OF THE INVENTION

According to one exemplary embodiment, the present invention is an apparel including a front portion, a rear portion, a first continuous member and a second continuous member. The front portion is configured to extend along a wearer's chest while the rear portion is configured to extend along the wearer's back. The first continuous member and the second continuous member extend between the front portion and the rear portion across the wearer's shoulders when the apparel is worn. The first continuous member and the second continuous member further slidably extend along one or both of the front portion and the rear portion. The first continuous member and the second continuous member each also extend between the front portion and the rear portion along the wearer's side when the apparel is worn. The first continuous member and the second continuous member each have an adjustable length.

According to another exemplary embodiment, the present invention includes an apparel comprising a front portion, a rear portion, a first continuous member and a second continuous member. The front portion is configured to extend along a wearer's chest while the rear portion is configured to extend to along the wearer's back. The rear portion includes a plurality of layers. The first continuous member and the second continuous member are each configured to extend from the front portion to the rear portion such that the first and second continuous members are adapted to extend over the wearer's shoulders when the apparel is worn. The first continuous member and the second continuous member each slidably extend along the rear portion between the plurality of layers. The first continuous and the second continuous member are each further configured to extend from the rear portion to the front portion along the wearer's side. The first continuous member and the second continuous member each have an adjustable length.

According to yet another exemplary embodiment, the present invention comprises includes a personal flotation device comprising a front portion, a rear portion, a first continuous member, a second continuous member and at least one guide coupled to the rear portion. The front portion is configured to extend along the wearer's chest while the rear portion is configured to extend along the wearer's back. The rear portion includes a plurality of layers. At least one of the plurality of layers includes a flotation material. The first continuous member and the second continuous member each extend from the front portion to the rear portion, such that the first and second continuous members are adapted to extend over the wearer's shoulders. The first continuous member and the second continuous member each include a cushioned portion adapted to contact the wearer's shoulder. The first continuous member and the second continuous member each further slidably extend along the rear portion and extend from the rear portion to the front portion along the wearers side. The at least one guide is configured to direct at least one of the first continuous member and the second continuous member from a longitudinally extending orientation to a transversely extending orientation.

DETAILED DESCRIPTION OF THE PREFERRED EMBODIMENTS

Figure 1:
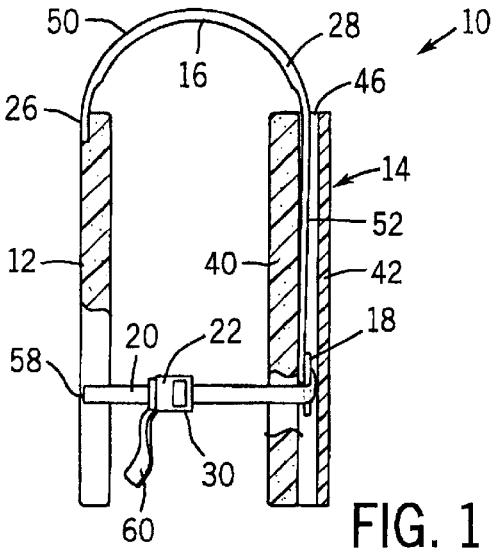
FIG. 1 is a schematic sectional view of a personal flotation device of the present invention taken along lines 1—1 of FIG. 2.
Figure 2:
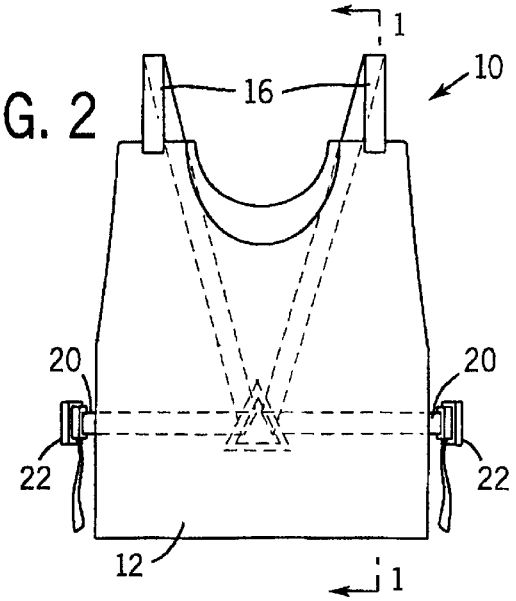
FIG. 2 is a front elevational view of the personal flotation device of FIG. 1.
Figure 3:
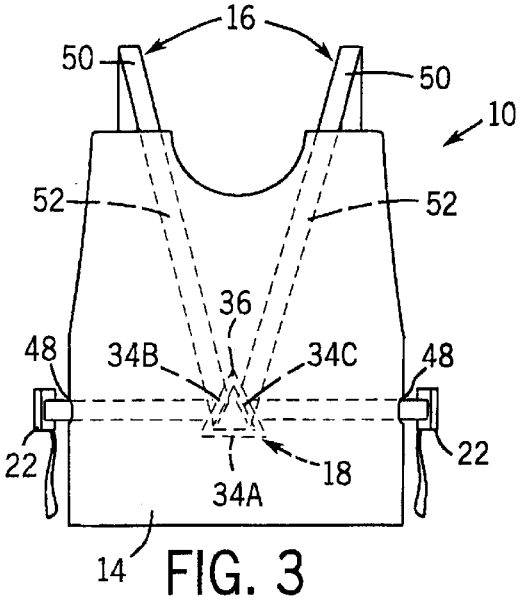
FIG. 3 is a rear elevational view of the personal flotation device of FIG. 1.

FIGS. 1–3 schematically illustrate an apparel (shown as personal flotation device 10), an exemplary embodiment of the present invention. Personal flotation device 10 generally includes front flotation panel 12, rear flotation panel 14, shoulder supports 16, guide 18, adjustment straps 20 and adjustable connectors 22. Front flotation panel 12 comprises a conventionally known front flotation panel including flotation foam or other buoyant material adapted to be positioned along a front of a user's torso and chest. The materials and layering of front flotation panel 12, as well as rear panel 14, are similar to the front and rear flotation panels disclosed in co-pending U.S. patent application Ser. No. 08/880,867 filed on Jun. 23, 1997 and U.S. Pat. No. 4,937,277, the full disclosures of which are hereby incorporated by reference.

Rear flotation panel 14 comprises a rear panel including one or more layers of flotation foam or other buoyant material and covering layers such as nylon. Panel 14 is sized and configured so as to extend along a user's back.

Shoulder supports 16 are elongate straps or webbing of material having a first end 26 affixed to front panel 12, a length 28 extending through guide 18 and a second end 30 secured to connector 22. Shoulder supports 16 are adapted to extend across each of a user's shoulders to support front panel 12 and rear panel 14 on a user.

Guide 18 is secured to rear panel 14 and provides at least one guide surface about which support 16 is at least partially wrapped so as to change direction from a longitudinal direction to a transverse direction so as to extend toward the side of rear panel 14. As best shown by FIG. 3, guide 18 is triangular shaped and has three legs 34A, 34B and 34C. Leg 34A and point 36 of guide 18 are secured to rear panel 14 by stitching, sonic welds, adhesive or other fastening means. As shown by FIG. 3, shoulder supports 16 wrap about legs 34B and 34C so as to extend toward sides 38 of rear panel 14.

In the exemplary embodiment, guide 18 is sandwiched between separate layers of rear panel 14. As best shown by FIG. 1, shoulder supports 16 extend between layers 40 and 42 which slidably receive supports 16. Shoulder supports 16 extend through an opening 46 between layers 40 and 42 along a top portion of rear panel 14, extend through guide 18 and extend out side openings 48 between layers 40 and 42 along side portions of rear panel 14. In the exemplary embodiment, layer 42 comprises flotation foam while layer 40 comprises a layer of thin material such as nylon. Alternatively, layer 42 may comprise a thin covering layer such as nylon while layer 40 comprises a layer of flotation foam or other buoyant material. Furthermore, in lieu of utilizing two spaced layers, rear panel 14 may include multiple layers of various combinations of flotation foam and covering layers. Guide 18 may alternatively be positioned on an exterior surface of rear panel 14 such that shoulder support 16 also extends along an exterior surface of rear panel 14.

Shoulder supports 16 may comprise a single strap or webbing of material, such as nylon or neoprene, or may include multiple straps of different material secured to one another so as to overlap one another or so as to be secured to one another end-to-end. In the exemplary embodiment, shoulder support 16 includes a cushioned portion 50 and a strap portion 52. Cushioned portion 50 comprises a soft and preferably stretchable band or web of material such as neoprene. At the same time, strap portion 52 comprises a thin, preferably non-stretchable material such as nylon secured to cushioned portion 50. Although less desirable, shoulder supports 16 may each be formed from a single material, such as entirely out of nylon, or entirely out of a stretchable material, such as neoprene.

Connector 22 is fastened to support 16 at end 30 and is configured to adjustably connect end 30 of support 16 to strap 20. In the exemplary embodiment, connector 22 comprises a conventionally known ladder-lock connector. As will be appreciated, various other conventionally known adjusting hardware may be employed in lieu of connector 22. Although less desirable, connector 22 may alternatively be secured to strap 20 or may be directly secured to front panel 12, wherein end 30 of each shoulder support 16 is sent through connector 22 for adjusting shoulder support 16.

Strap 20 extends on each side of personal flotation device 10 and includes a first end 58 affixed to front panel 12 and a second opposite end 60 threaded through connector 22. End 60 is easily grasped by the wearer of personal flotation device 10 and may be pulled through connector 20 to adjust the overall length of supports 16 and straps 20 extending over the user's shoulders and along a user's sides. When a user adjusts the length of strap 20 by pulling on end 60, the length of shoulder support 16 extending between front panel 12 and rear panel 14 is adjusted such that rear panel 14 telescopically receives shoulder support 16 to a greater extent to draw personal flotation device 10 up on the user and closer about the user's upper chest.

Overall, shoulder supports 16, adjustment straps 20 and adjustable connectors 22 form a pair of continuous members that extend from front portion 12 to rear portion 14 over the wearer's shoulders when personal flotation device 10 is worn. Each continuous member slidably extends along rear portion 14 and also extends between rear portion 14 and front portion 12 along the wearer's side when personal flotation device 10 is worn. Each continuous member has an adjustable length. Adjustment of the length of the continuous member formed by support 16, strap 20 and connector 22 causes rear portion 14 to slide along the continuous member to a new position relative to front portion 12. As a result, the relative positions of front portion 12 and rear portion 14 as well as the length of the shoulder support 16 extending across the wearer's shoulders may be easily adjusted. Although each continuous member is illustrated as comprising two elongate spans of material interconnected by an adjustable connector, each continuous member may alternatively comprise a single elongate span of material or materials or greater than two spans of material or materials joined to one another.

Figure 4:
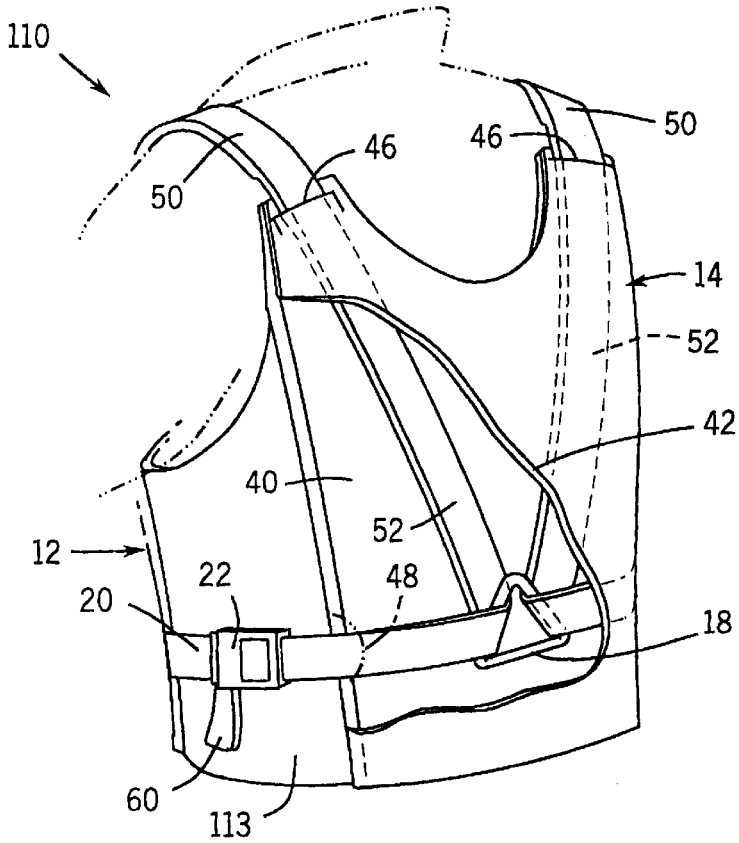
FIG. 4 is a rear perspective view of a first alternative embodiment of the personal flotation device of FIGS. 1–3 while being worn by a user (shown in phantom) in an upright orientation, wherein portions are broken away for purposes of illustration.
Figure 5:
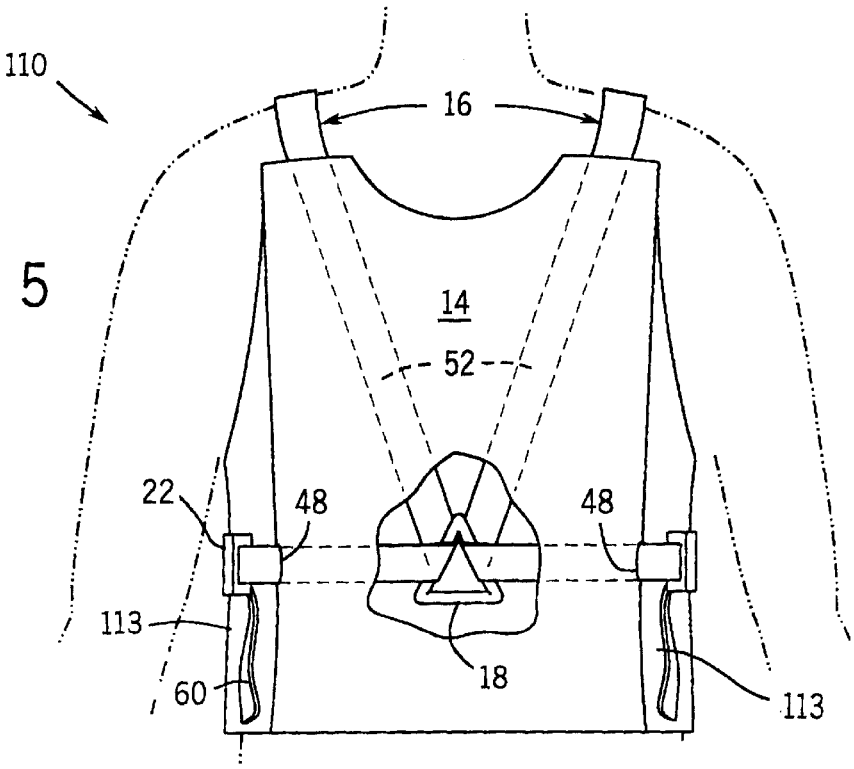
FIG. 5 is a rear elevational view of the personal flotation device of FIG. 4 being worn by a user, wherein portions are shown broken away for purposes of illustration.

FIGS. 4 and 5 illustrate personal flotation device 110, an alternative embodiment of personal flotation device 10, being worn by a user. For ease of illustration, those basic components of personal flotation device 110 which correspond to the above described components of personal flotation device 10 are numbered similarly. Personal flotation device 110 is similar to personal flotation device 10 in most respects except that personal flotation device 110 has a front panel 12 and a rear panel 14 which include side lobes or portions 113 which overlap one another and which are releasably secured to one another by Velcro, fasteners, hook and loop fasteners or other fastening mechanisms. Alternatively, side portions 113 may be permanently affixed to one another such that personal flotation device 110 is configured similar to a shirt. Although not illustrated, front panel 12 of personal flotation device 10 may alternatively be formed by two halves which are releasably secured to one another by buckles, by hook and loop fasteners, by zipper mechanisms or by other fastening mechanisms such that personal flotation device 110 is worn like a jacket. FIG. 4 illustrates personal flotation device 110 with portions of rear panel 14 broken away to best illustrate support 16 extending into opening 46 between panels 42 and 40, through and about guide 18 and through opening 48.

Figure 6:
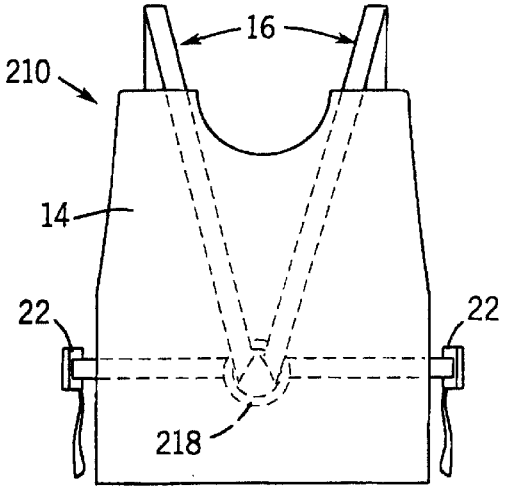
FIG. 6 is a rear elevational view of a second alternative embodiment of the personal flotation device of FIG. 1.
Figure 7:
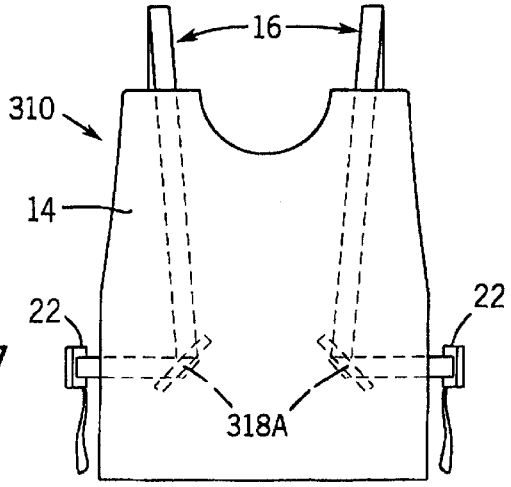
FIG. 7 is a rear elevational view of a third alternative embodiment of the personal flotation device shown in FIG. 1.

FIGS. 6 and 7 illustrate personal flotation devices 210 and 310, respectively, alternative embodiments of personal flotation device 10 shown in FIGS. 1–3. Personal flotation devices 210 and 310 are substantially identical to personal flotation device 10 except that personal flotation devices 210 and 310 include guides 218 and 318A, respectively, in lieu of guide 18. For ease of illustration, those remaining components of devices 210 and 310 which correspond to the described components of personal flotation device 10 are numbered similarly. As best shown by FIG. 6, guide 218 generally comprises a circular ring affixed at spaced points to rear panel 14 so as to allow shoulder support 16 to loop about portions of guide 218 so as to change direction and so as to extend outward to sides of rear panel 14 for connection to strap 20 (not shown) via connector 22. In lieu of guide 218 being circular, guide 218 may be oval or have any of a variety of alternative shapes.

As best shown by FIG. 7, guide 18 may be replaced by separate spaced guides 318A, 318B adapted to guide each shoulder support 16 independent of one another. Guides 318A comprise sleeves or loops having opposite ends secured to rear panel 14 and configured to allow shoulder support 16 to be looped or wrapped thereabout so as to change direction to extend outward away from one another to sides of rear panel 14 for connection to strap 20 (not shown) via connector 22. In the exemplary embodiment, guides 318A, 318B are preferably angled. Alternatively, guides 318A, 318B may be positioned at various other angles. Moreover, guides 318A, 318B may alternatively comprise triangular shaped members such as member 18 or circular or oval-shaped members such as guide 218.

Figure 8:
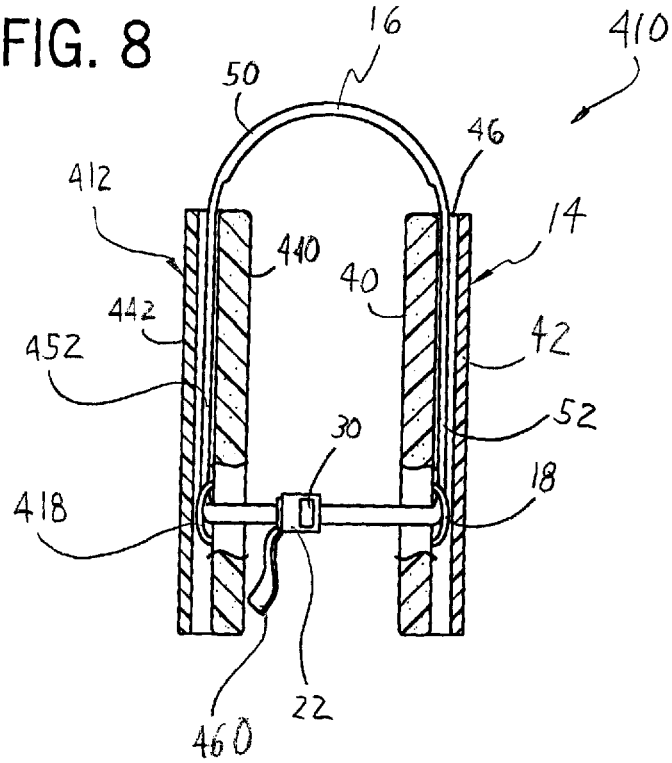
FIG. 8 is a schematic sectional view of a fourth alternative embodiment of the personal flotation device of FIGS. 1–3, wherein the sectional view is taken generally along the same relative location as FIG. 1.

FIG. 8 illustrates personal flotation device 410, yet another alternative embodiment of personal flotation device 10 shown in FIGS. 1–3. Personal flotation device 410 is similar to personal flotation device 10 except that personal flotation device 410 includes front flotation panel 412 and strap portion 452 in lieu of front portion 12 and strap 20, respectively. Device 410 additionally includes guide 418. Those remaining components of personal flotation device 410 which correspond to similar components of personal flotation device 10 are numbered similarly.

Front flotation panel 412 is substantially similar to rear flotation panel 14 in structure. Depending upon the application and the intended wearer, front flotation panel 412 may have slightly different dimensions as well as a different buoyancy as compared to rear flotation panel 14. Front flotation panel 412 includes layers 440 and 442 which slidably receive strap portion 452 therebetween. Layer 440 preferably comprises one or more layers of flotation foam. Layer 440 comprises a layer of covering material such as nylon. Alternatively, both layers 440 and 442 may comprise a layer of flotation foam or other buoyant material. Furthermore, layer 440 may alternatively comprise a layer of covering material while layer 442 comprises a layer of flotation foam or other buoyant material. Although not specifically illustrated, the layers of flotation foam each preferably include one or more layers of a protective covering material such as nylon or neoprene. Moreover, although not specifically illustrated, one or both of layers 440 and 442 may be selectively creased to provide bend lines. In addition, although front panel 412 is illustrated as being composed of such two layers, panel 412 may alternatively be comprised of greater than two layers coupled to one another or a single layer, wherein strap portion 452 is slidably supported along an exterior surface of front panel 412 by sleeves, rings or other guiding structures.

Strap portion 452 replaces strap 20 and is substantially identical in function to strap portion 52. Strap portion 452 extends from shoulder support 16 between layers 440 and 442 and through guide 418 to adjustable connector 422. Strap portion 452 slides relative to front panel 412 and is preferably formed from one or more materials similar to that of strap portion 52.

Guide 418 is substantially identical to guide 18. Guide 418 redirects strap portion 452 from a generally longitudinally extending orientation to a generally transversely extending orientation when personal flotation device 410 is being worn and the person wearing device 410 is in an upright orientation. Similar to personal flotation devices 110, 210 and 310, guide 418 may alternatively comprise various other configured guides. Guide 418 enables end 460 of strap portion 452 to be adjustably connected to connector 22 whereby the length of each continuous member formed by shoulder support 16, strap portion 452, strap portion 52 and connector 22 may be easily adjusted. Similar to personal flotation devices, 10, 110, 210 and 310, personal flotation device 410 enables front panel 412 and rear panel 14 to be easily adjusted relative to one another and to further enable shoulder supports 16 to be adjusted by simply adjusting the length of the continuous member formed by shoulder supports 16, strap portion 52, strap portion 452 and connector 22.

Figure 9:
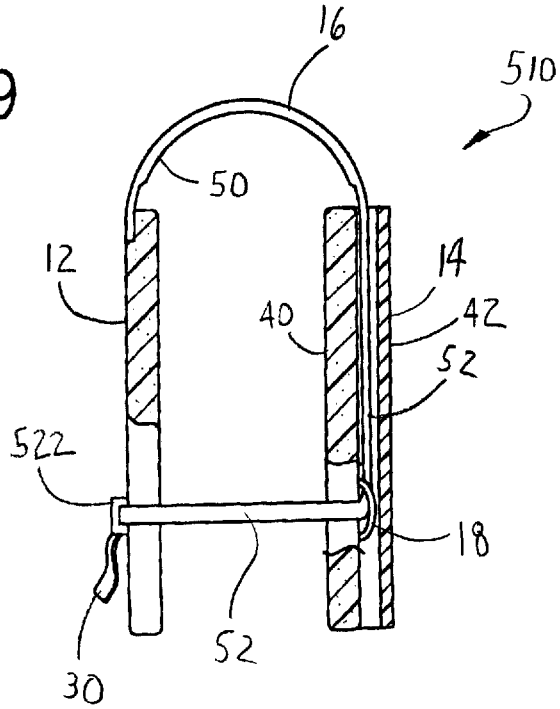
FIG. 9 is a schematic sectional view of a fifth alternative embodiment of the personal flotation device of FIGS. 1–3, wherein the sectional view is taken generally along the same relative location as FIG. 1.

FIG. 9 illustrates personal flotation device 510, yet another alternative embodiment of personal flotation device 10 shown in FIGS. 1–3. Personal flotation device 510 is similar to personal flotation device 10 except that personal flotation device 510 omits strap 20 and includes connector 522 in lieu of connector 22. For ease of illustration, those remaining components of personal flotation device 510 which correspond to similar components of personal flotation device 10 are numbered similarly. Connector 522 comprises an adjustable connector, such as a ladder lock, secured or coupled directly to front panel 12 so as to be located along front panel 12 below the chest and adjacent the abdomen of the person wearing personal flotation device 510. Connector 522 receives end 30 of strap portion 52 of shoulder support 16. Connector 522 enables end 30 to be adjustably positioned relative to connector 522 so as to enable adjustment of the length of shoulder support 16. By simply pulling upon end 30, the person wearing flotation device 510 may adjust the relative positions of front panel 12 and rear panel 14 as well as the length of shoulder support 16. Similar to personal flotation devices 10, 110, 210, 310 and 410, personal flotation device 510 enables the person wearing the personal flotation device to easily adjust the positioning of front panel 12 and rear panel 14 by accessing an adjustment mechanism located distant the user's shoulders, below the user's chest, generally along the user's abdomen and preferably at the user's sides.

Overall, personal flotation devices 10, 110, 210, 310, 410 and 510 provide personal flotation devices or life jackets which have shoulder straps that are easily adjustable from the user's sides rather than from above or near the user's shoulders. Moreover, personal flotation devices 10, 110, 210, 310, 410 and 510 eliminate the need for buckles or other fasteners adjacent the user's shoulders for adjustment of the shoulder supports. As a result, personal flotation devices 10, 110, 210, 310, 410 and 510 do not include buckles which at times may catch upon other objects. In addition, personal flotation devices 10, 110, 210, 310, 410 and 510 are simpler and cleaner, providing such personal flotation devices with an improved aesthetic appearance and a reduced manufacturing cost.

Although each of the above described features is described for beneficial use as on a personal flotation device, such features may alternatively be used on other apparel also requiring shoulder straps having adjustable lengths. In such alternative applications, slight modifications may be required. For example, the above described features may additionally be employed in scuba diving buoyancy compensators wherein the front portion and/or rear portion of the buoyancy compensator apparel is selectively inflated and deflated to provide the buoyancy compensator with temporary buoyancy or to adjust the buoyancy thereof. The above described features may also be utilized in various load carrying apparel such as backpacks, fire fighting equipment supporting apparel, camera equipment carrying apparel and the like.

Although the present invention has been described with reference to preferred embodiments, workers skilled in the art will recognize that changes may be made in form and detail without departing from the spirit and scope of the invention. For example, although different preferred embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. An apparel comprising:

a front portion configured to extend along a wearer's chest;

a rear portion configured to extend along the wearer's back;

a first continuous member configured to extend from one of the front portion and the rear portion to the other of the front portion and the rear portion such that the first continuous member is adapted to extend over the wearer's shoulder when the apparel is being worn, wherein the first continuous member is configured to slidably extend along the other of the front portion and the rear portion, wherein the first continuous member is configured to extend from the other of the front portion and the rear portion to said one of the front portion and the rear portion along the wearer's side and wherein the first continuous member has an adjustable length; and a second continuous member configured to extend from one of the front portion and the rear portion to the other of the front portion and the rear portion such that the second continuous member is adapted to extend over the wearer's shoulder when the apparel is being worn, wherein the second contiguous member is configured to slidably extend along the other of the front portion and the rear portion, wherein the second continuous member is configured to extend from the other of the front portion and the rear portion to said one of the front portion and the rear portion along the wearer's side and wherein the second continuous member has an adjustable length.

2. The apparel of claim 1 including a first guide coupled to the other of the rear portion and the front portion, wherein the first guide is configured to direct the first continuous member from a generally vertical orientation to a generally horizontal orientation when the apparel is being worn by an individual in an upright orientation.

3. The apparel of claim 2, wherein the first continuous member is at least partially looped about the first guide.

4. The apparel of claim 2, wherein the first guide is configured to direct the second continuous member from a generally vertical orientation to a generally horizontal orientation when the apparel is being worn.

5. The apparel of claim 4, wherein the first guide is triangular.

6. The apparel of claim 4, wherein the first guide is circular.

7. The apparel of claim 2 including a second guide coupled to the other of the rear portion and the front portion, wherein the second guide is configured to direct the second continuous member from a generally vertical orientation to a generally horizontal orientation when the apparel is being worn by an individual in an upright orientation.

8. The apparel of claim 1, wherein the other of the front portion and the rear portion includes a plurality of layers slidably receiving the first continuous member therebetween.

9. The apparel of claim 8, wherein the other of the front portion and the rear portion includes at least one inner layer and at least one outer layer slidably receiving the first continuous member therebetween, wherein the at least one outer layer includes at least one layer of flotation material.

10. The apparel of claim 1, wherein the first continuous member has a length adjuster disposed between the rear portion and the front portion and configured to be disposed at the wearer's side when the apparel is being worn.

11. The apparel of claim 1, wherein the first continuous member includes a shoulder support and a strap.

12. The apparel of claim 1, wherein the first continuous member has a first end affixed to said one of the front portion and the rear portion and a second end affixed to said one of the front portion and the rear portion.

13. The apparel of claim 12, wherein the first continuous member includes:

a shoulder support providing the first end slidably coupled to the other of the front portion and the rear portion; and a strap providing the second end and adjustably coupled to the shoulder support.

14. The apparel of claim 1, wherein the first continuous member slidably extends along said one of the front portion and the rear portion.

15. The apparel of claim 1, wherein the first continuous member and the second continuous member slidably extend along the rear portion.

16. The apparel of claim 1, wherein the front portion and the rear portion are at least temporarily buoyant.

17. The apparel of claim 16, wherein the front portion and the rear portion are each permanently buoyant.

18. The apparel of claim 17, wherein the front portion and the rear portion each include at least one layer of flotation foam.

19. The apparel of claim 1, wherein at least a portion of the first continuous member and the second continuous member are cushioned.

20. The apparel of claim 1, wherein the first continuous member includes a cushioned shoulder support configured to extend across the wearer's shoulder when the apparel is being worn.

21. The apparel of claim 1 including opposite side portions extending between the front portion and the rear portion.

22. An apparel comprising:

a front portion configured to extend along a wearer's chest;

a rear portion configured to extend along the wearer's back, the rear portion including a plurality of layers;

a first continuous member configured to extend from the front portion to the rear portion such that the first continuous member is adapted to extend over the wearer's shoulder when the apparel is being worn, wherein the first continuous member slidably extends along the rear portion between the plurality of layers, wherein the first continuous member is configured to extend from the rear portion to the front portion along the wearer's side, and wherein the first continuous member has an adjustable length; and a second continuous member configured to extend from the front portion to the rear portion such that the second continuous member is adapted to extend over the wearer's shoulder when the apparel is being worn, wherein the second continuous member slidably extends along the rear portion between the plurality of layers, wherein the second continuous member is configured to extend from the rear portion to the front portion along the wearer's side, and wherein the second continuous member has an adjustable length.

23. The apparel of claim 22, wherein the front portion and the rear portion are buoyant.

24. The apparel of claim 22 including at least one guide coupled to the rear portion and configured to direct at least one of the first continuous member and the second continuous member from a general vertical orientation to a generally horizontal orientation when the apparel is being worn and the wearer is in an upright orientation.

25. A personal flotation device comprising:

a front portion configured to extend along a wearer's chest;

a rear portion configured to extend along the wearer's back, the rear portion including a plurality of layers, wherein at least one of the plurality of layers includes a flotation material;

a first continuous member extending from the front portion to the rear portion such that the first continuous member is adapted to extend over the wearer's shoulder, wherein the first continuous member includes a cushioned portion adapted to contact the wearer's shoulder, wherein the first continuous member slidably extends along the rear portion, wherein the first continuous member extends from the rear portion to the front portion and is adapted to extend along the wearer's side;

a second continuous member extending from the front portion to the rear portion such that the second continuous member is adapted to extend over the wearer's shoulder, wherein the second continuous member includes a cushioned portion adapted to contact the wearer's shoulder, wherein the second continuous member slidably extends along the rear portion, wherein the second continuous member extends from the rear portion to the front portion and is adapted to extend along the wearer's side; and at least one guide coupled to the rear portion and configured to direct at least one of the first continuous member and the second continuous member from a longitudinally extending orientation to a transversely extending orientation.

26. The personal flotation device of claim 25, wherein the plurality of layers of the rear portion includes at least one inner layer and at least one outer layer, wherein the at least one outer layer includes flotation foam.

* * * * *